US005990411A

United States Patent [19]

Kellar

[11] Patent Number: 5,990,411

[45] Date of Patent: Nov. 23, 1999

[54] METHODS FOR UTILIZING SWITCHES ON THE BACK OF THE NECK OF A MUSICAL INSTRUMENT

[75] Inventor: Bradford S. Kellar, Palo Alto, Calif.

[73] Assignee: Kellar Bass Systems, Palo Alto, Calif.

[21] Appl. No.: 09/072,413

[22] Filed: May 4, 1998

[51] Int. Cl.[6] ..... G10H 1/18; G10H 3/12

[52] U.S. Cl. ..... 84/742; 84/293

[58] Field of Search ..... 84/718, 720, 722, 84/742, 293

[56] References Cited

U.S. PATENT DOCUMENTS

| | | | |
|---|---|---|---|
| 2,792,738 | 5/1957 | Donahue . | |
| 2,910,906 | 11/1959 | Libera . | |
| 3,116,357 | 12/1963 | Krebs . | |
| 3,196,729 | 7/1965 | Burns et al. . | |
| 3,217,079 | 11/1965 | Murrell . | |
| 3,223,771 | 12/1965 | Hopping . | |
| 3,530,226 | 9/1970 | Wheeler et al. . | |
| 3,530,227 | 9/1970 | Wheeler et al. . | |
| 4,901,618 | 2/1990 | Blum, Jr. . | |
| 5,033,353 | 7/1991 | Fala et al. | 84/743 X |
| 5,095,799 | 3/1992 | Wallace et al. . | |
| 5,633,474 | 5/1997 | Cardey, III | 84/737 |

*Primary Examiner*—Jeffrey Donels
*Attorney, Agent, or Firm*—Ritter, Van Pelt & Yi LLP

[57] ABSTRACT

Methods and apparatuses for utilizing switches on the back of the neck of a musical instrument are provided. Multiple switches may be positioned along the length of the back of the neck of a musical instrument to produce tones to accompany the musical instrument. The pitch of the tones generated by activation of the switches may vary depending upon the position of the switches along the back of the neck of the musical instrument. With embodiments of the invention, a musician is able to play both music for an electric guitar and music for a bass guitar at the same time.

32 Claims, 14 Drawing Sheets

| | NOTE | MIDI# | 32 16 8 4 2 1<br>$D_5$ $D_4$ $D_3$ $D_2$ $D_1$ $D_0$ | y |
|---|---|---|---|---|
| 1 | e | 28 | 0 1 1 1 0 0 | 5 |
| 2 | f | 29 | 0 1 1 1 0 1 | 6 |
| 3 | f# | 30 | 0 1 1 1 1 0 | 7 |
| 4 | g | 31 | 0 1 1 1 1 1 | 8 |
| 5 | g# | 32 | 1 0 0 0 0 0 | 1 |
| 6 | a | 33 | 1 0 0 0 0 1 | 2 |
| 7 | a# | 34 | 1 0 0 0 1 0 | 3 |
| 8 | b | 35 | 1 0 0 0 1 1 | 4 |
| 9 | c | 36 | 1 0 0 1 0 0 | 5 |
| 10 | c# | 37 | 1 0 0 1 0 1 | 6 |
| 11 | d | 38 | 1 0 0 1 1 0 | 7 |
| 12 | d# | 39 | 1 0 0 1 1 1 | 8 |
| 13 | e | 40 | 1 0 1 0 0 0 | 1 |
| 14 | f | 41 | 1 0 1 0 0 1 | 2 |
| 15 | f# | 42 | 1 0 1 0 1 0 | 3 |
| 16 | g | 43 | 1 0 1 0 1 1 | 4 |
| 17 | g# | 44 | 1 0 1 1 0 0 | 5 |
| 18 | a | 45 | 1 0 1 1 0 1 | 6 |

METHODS FOR UTILIZING SWITCHES ON THE BACK OF THE NECK OF A MUSICAL INSTRUMENT

BACKGROUND OF THE INVENTION

The present invention relates to musical instruments. More specifically, the invention relates to utilizing switches on the back of the neck of a musical instrument for producing sounds.

There are many musical instruments that allow the musician to play multiple parts of songs simultaneously. For example, a musician is able to play both the melody and accompanying chords on the piano at the same time. As another example, an organist can play melodies and chords with the hands, and the bass part with the feet. The music produced by these musical instruments is often so full that no other musical accompaniment is necessary.

There are many other musical instruments that by the very nature of the way they are traditionally played makes it difficult, if not impossible, for a musician to play multiple individual parts of a musical piece. For example, stringed instruments such as the guitar generally require both hands to play a musical note. The fingers of one hand hold one or more strings against the fingerboard, while the other hand picks or strums the strings. Thus, musicians of traditional guitars are limited with regard to the number of notes or parts of songs that can be played individually.

There have been attempts to increase the flexibility of traditional stringed instruments by placing switches on the fingerboard of the instrument. When the musician depresses a string to contact the fingerboard, a switch is activated that may produce tones to accompany the music generated by the stringed instrument. Although such techniques may increase the tonal range of the instrument, the musician is still limited to playing a single part of the musical score. In other words, the range of notes produced by the stringed instrument may be increased, but the musician is still limited with regard to the number of individual parts of a song that may be played simultaneously.

Accordingly, there is a need for innovative methods and apparatuses for modifying stringed instruments so that the musician is able to play multiple parts of a musical piece. It would be desirable for these techniques to be inexpensive and non-damaging to the musical instruments so musicians would be able to apply these techniques to the instruments of their choice.

SUMMARY OF THE INVENTION

The present invention provides innovative techniques for utilizing switches on the back of the neck of a musical instrument for producing sounds. Switches are positioned along the back of the neck of the musical instrument so that the musician is able to activate the switches with her thumb. The switches may be coupled to an electronic circuit for producing tones that vary in pitch according to the position of each switch along the back of the neck. For example, the switches may be coupled to the back of the neck of a guitar such that the switches produce tones that correspond to tones produced by a bass guitar. Because the switches are manipulated by the thumb, the musician is able to play multiple individual parts of a musical piece simultaneously without significantly affecting the way the musician plays. Several embodiments of the invention are described below.

In one embodiment, the invention provides an apparatus for use with a musical instrument. The apparatus includes multiple switches (e.g., an array of switches) that are adapted for mounting on the back of the neck of the musical instrument so that the array of switches are positioned along the length of the back of the neck. The switches may be activated by a user's thumb to produce sounds, produce chords or control such items as lighting, stage effects, sounds produced, or recording. In a preferred embodiment, the sounds produced correspond to tones produced by a bass guitar and vary in pitch according to the position of each switch along the back of the neck.

In another embodiment, the invention provides a musical instrument including a neck with a front and a back. The neck includes multiple switches positioned along the length of the back of the neck. The switches may, for example, produce tones that vary in pitch according to the position of each switch along the back of the neck of the musical instrument.

In another embodiment the invention provides a method of augmenting a musical instrument with a neck including a front and a back. A fingerboard is located on the front of the neck and multiple switches are coupled along the back of the neck so that the switches may be depressed by the user's thumb. The switches may be electrically coupled to an electronic circuit that interprets which switches have been activated and produces the desired tones. In preferred embodiments, the switches are attached to the back of the neck so that the musical instrument is not damaged and the switches may be easily removed (e.g., utilizing an adhesive).

In another embodiment, the invention provides a method of playing a musical instrument with a neck including a front and a back. The user couples fingers of a hand to a fingerboard on the front of the neck in order to produce tones of varying pitch. The user may also couple the thumb of the hand to one of multiple switches positioned along the length of the back of the neck. In preferred embodiments, the thumb plays a different part of a musical piece than the fingers.

Other features and advantages of the invention will become readily apparent upon review of the following detailed description in association with the accompanying drawings.

DETAILED DESCRIPTION OF PREFERRED EMBODIMENTS

In the description that follows, the present invention will be described in reference to preferred embodiments that are designed for traditional guitars. In particular, the drawings show a six-string electric guitar. However, the invention is not limited to any particular stringed instrument as it may be advantageously applied to other stringed instruments including violins, acoustic guitars, twelve-string guitars, banjos, bass guitars, ukuleles, cellos, basses, and the like. Additionally, the invention may be advantageously applied to musical instruments that include a neck but have switches on the fingerboard instead of traditional strings. Therefore, the description of the embodiments that follows is for purposes for illustration and not limitation.

Figure 1:
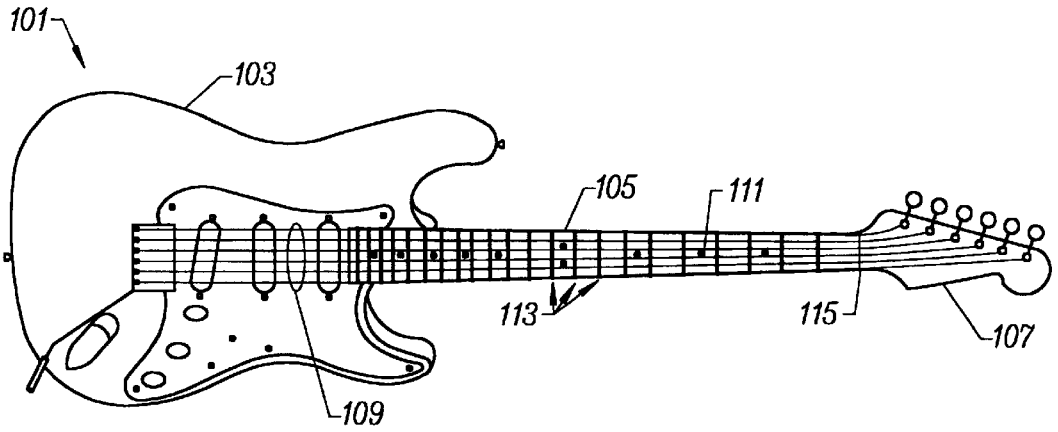
FIG. 1 PRIOR ART
FIG. 1 shows a traditional guitar.

FIG. 1 shows the front of a traditional guitar. A guitar 101 includes a body 103, a neck 105, and a head 107. Strings 109 are strung between body 103 and head 107. A fingerboard 111 is on the front of neck 105 and includes multiple frets 113 and a nut 115. When a musician utilizes her fingers to press a string against fingerboard 111, the string contacts a nearby fret thereby effectively shortening the length of the string which changes the pitch of the tone generated by the string when it is struck. When used herein, the term "finger" will be utilized to describe the four digits of a hand not including the thumb.

The electric guitar shown in FIG. 1 is fairly common. However, the invention may be advantageously applied to other musical instruments that are somewhat different from this guitar. For example, the guitar shown has frets and many stringed instruments, e.g., the violin, do not have frets on the fingerboard. Additionally, other musical instruments have had the strings removed all together and utilize switches on the fingerboard to electrically produce the desired tones. As will be readily apparent to one of skill in the art, the invention may be applied to these and other musical instruments.

Figure 2:
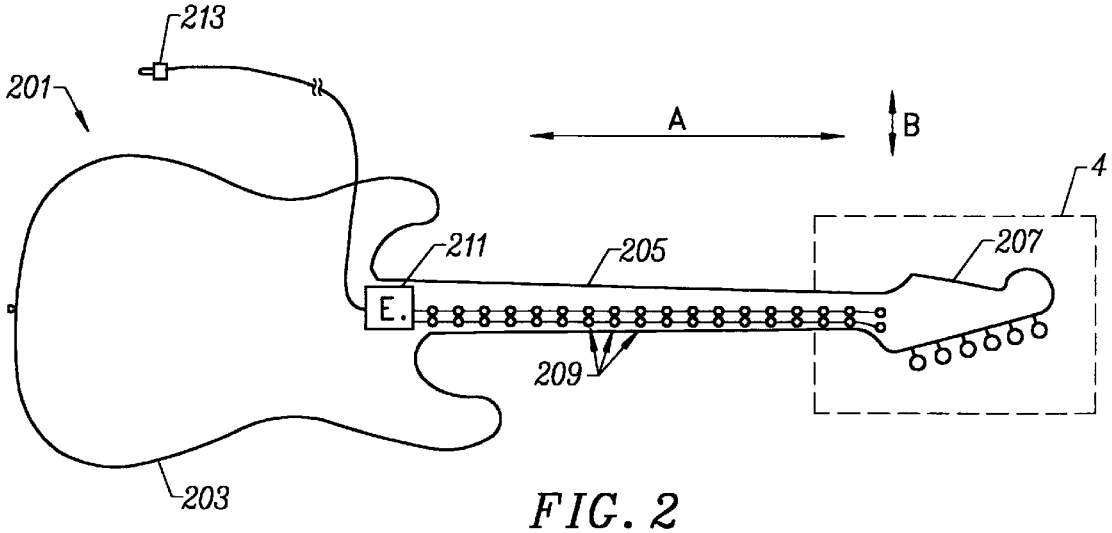
FIG. 2 shows an embodiment of the invention including multiple switches along the back of the neck of a guitar.

FIG. 2 shows the back of a guitar with an embodiment of the invention. A guitar 201 includes a body 203, a neck 205, and a head 207. On the back of the neck are positioned multiple switches 209. Switches 209 are electrically coupled to an electronic circuit 211. Electronic circuit 211 generates output through a plug 213. As will be described in more detail below, plug 213 may be for a bass amplifier, a MIDI synthesizer, stereo, and the like. As shown, switches 209 are positioned along the length of the back of the neck of guitar 201. When used herein, the length of the neck is in a direction from body 203 to head 207. As some musical instruments have bodies or heads that are practically reduced to nothing, the length of the neck should be understood to be the direction indicated by the double-headed arrow A in FIG. 2. Thus, if the musical instrument has strings, the length of the neck is substantially parallel to the strings.

The width of the neck will be used to describe a direction that is generally parallel to frets on the fingerboard. As some musical instruments do not have frets on the fingerboard, the width of the neck may also be defined as a direction along double-headed arrow B in FIG. 2.

Figure 3:
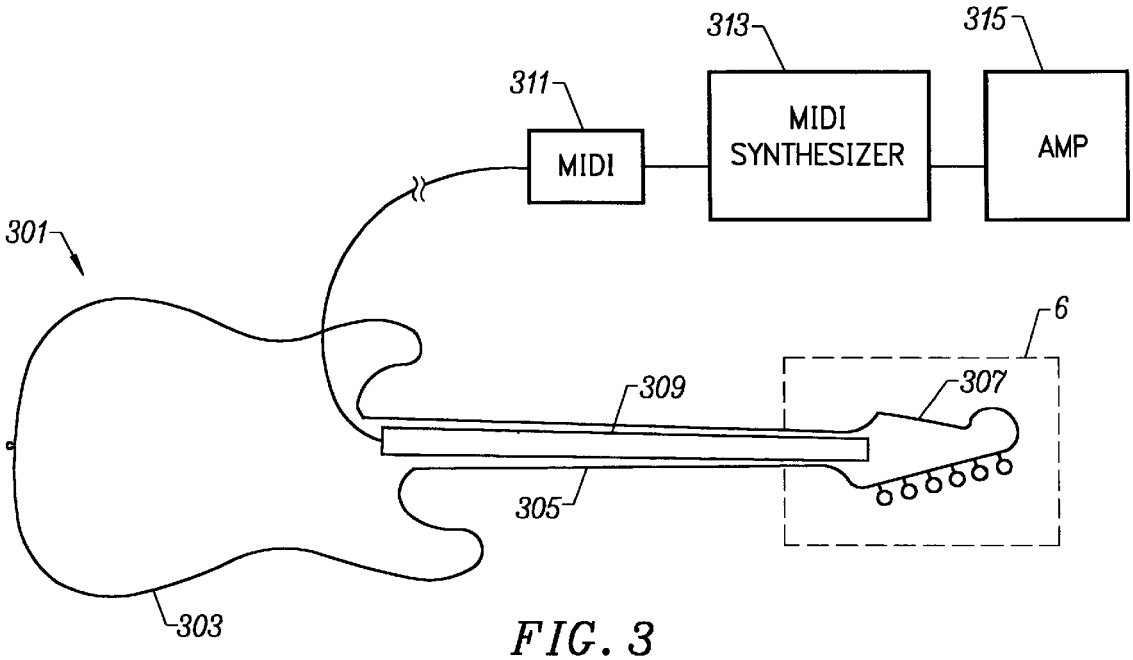
FIG. 3 shows another embodiment of the invention including a strip of switches along the back of the neck of a guitar.

The embodiment shown in FIG. 2 includes multiple individual switches along the back of the neck of the guitar. FIG. 3 shows another embodiment where a strip of switches is coupled to the back of the neck of a guitar. A guitar 301 includes a body 303, a neck 305, and a head 307. A strip of switches 305 is attached to the back of the neck so that the switches of the strip may be manipulated by the thumb of the user. Although the individual switches of strip 309 are not shown (see FIGS. 6 and 7), strip 309 includes multiple switches that are positioned along the length of the back of the neck and preferably, multiple rows of switches across the width of the neck. Strip 309 is electrically coupled to a MIDI box 311 that interprets the switches that have been activated and produces MIDI digital signals. The MIDI signals are then sent to a MIDI synthesizer 313 that generates the designated tones.

Figure 6:
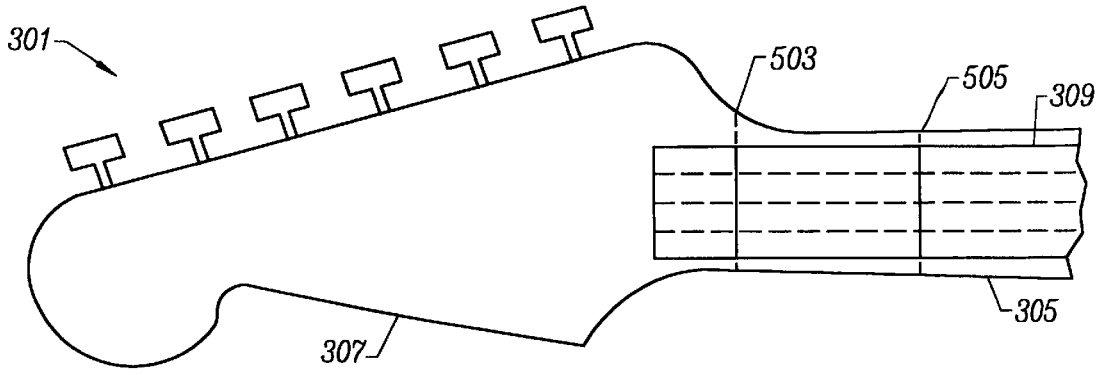
FIG. 6 shows a more detailed view of the head and upper neck of the guitar in FIG. 3.
Figure 4:
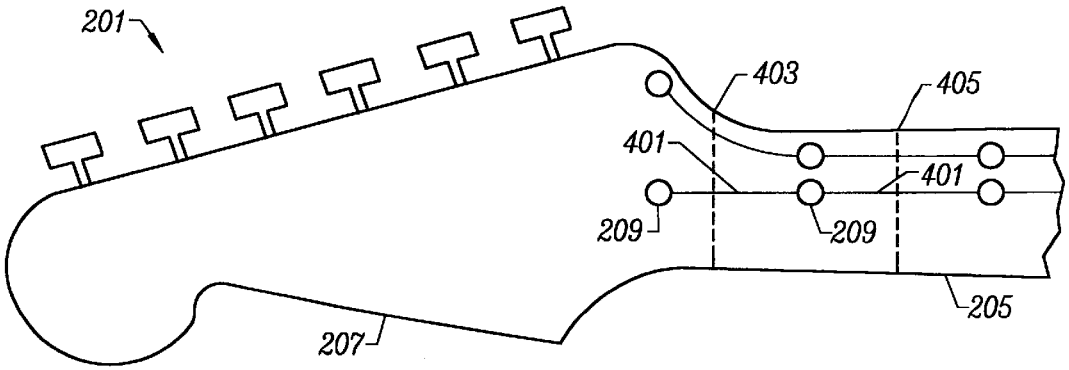
FIG. 4 shows a more detailed view of the head and upper neck of the guitar in FIG. 2.
Figure 5:
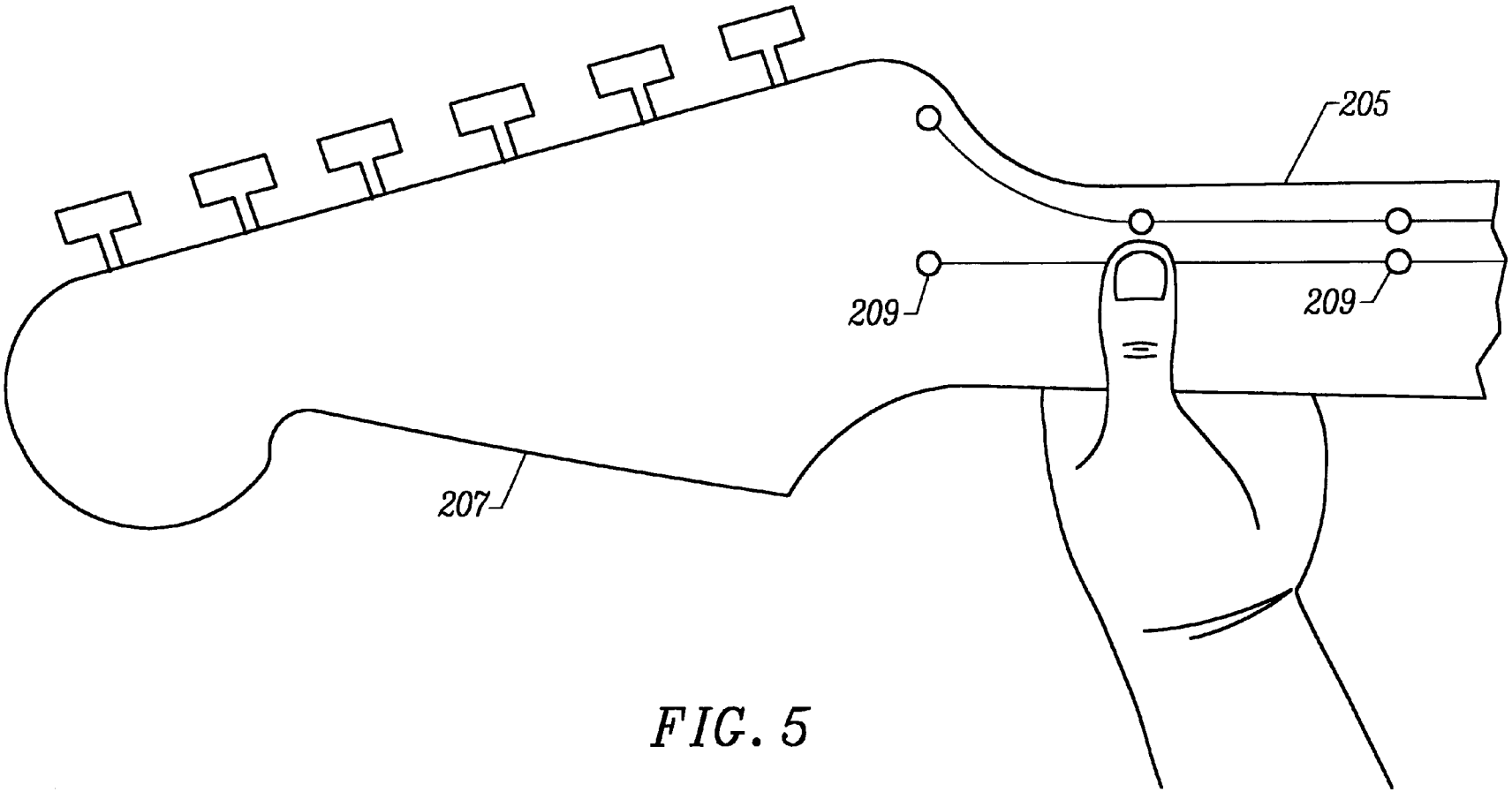
FIG. 5 shows how the switches in FIG. 4 may be depressed or activated by the thumb of a user's hand.

FIG. 4 shows a more detailed view of a section 4 of FIG. 2 that includes the head and upper neck of the guitar. FIGS. 4, 5 and 6 are in a perspective from a right-handed guitar player. Switches 209 are positioned along the back of the neck of guitar 201. As shown, there are multiple rows of switches across the width of the neck. Each row of switches is electrically coupled by one or more wires 401.

In the embodiment shown, there are two rows of switches corresponding to the two lowest strings of a bass guitar. Each switch produces tones that vary in pitch according to the position of the switch along the back of the neck. Furthermore, the tones vary in pitch depending on which row the switch is on. Accordingly, the switches may be positioned such that they may be readily identified by the user. For example, as shown, switches 209 are positioned on the back of the neck between the frets on the fingerboard on the front of the neck of the guitar. In a preferred embodiment where switches 209 correspond to tones produced by a bass guitar, there may be two switches to the left of nut 403 that correspond to the two lowest open strings of the bass guitar. Similarly, there may be two switches between nut 403 and a first fret 405 as shown, such that these switches correspond to tones produced by a bass guitar when the users fingers depress the string at the first fret of the bass guitar.

Although FIG. 4 shows two rows of switches, any number of rows of switches may be utilized with the invention. For example, four rows may be utilized with each row corresponding to a string of a bass guitar. The switches may be utilized to produce individual tones or chords. Additionally, the switches may be utilized not for producing sounds but for control of lighting, stage effects, sound (e.g., modify tones produced by the musical instrument), or recording. For example, the MIDI standard includes "show control" that may be utilized to control lights and stage props and "machine control" that may be utilized to control record functions of a studio tape recorder. The placement of the switches on the back of the neck is not limited to a linear placement of rows. The switches may be staggered or in arcs so that the user may more easily locate or active the switches. For example, the switches may be placed to facilitate a handicapped musician. Accordingly, the utility and placement of the switches is not limited to the embodiments shown.

FIG. 5 shows a user's thumb depressing a switch on the back of the neck of the guitar. While the user is playing music with strings (or in some embodiments, switches) on the fingerboard of the guitar, the user may play tones corresponding to a bass guitar with the thumb. In other embodiments the switches may be utilized to simulate other musical instruments (including percussion instruments), play chords, or to control lighting, stage effects, sound, or recording. Therefore, the switches may be utilized to produce sounds and special effects to accompany the music produced by the musician.

Referring now to FIG. 6, this figure shows a more detailed view of a section 6 of FIG. 3 that includes the head and upper neck of the guitar. Strip 309 includes multiple switches that may be activated by the thumb of the user to produce tones to accompany the musical instrument. Strip 309 may be positioned so that the switches are on the back of the neck between the frets (and nut) on the fingerboard on the guitar. In other words, the switches may be positioned on the back of the neck of the guitar such that they lie between the frets and nut on the fingerboard on the front of the neck of the guitar. Accordingly, strip 309 may include two switches to the left of a nut 503 that correspond to tones produced by an open string on a bass guitar. Similarly, strip 309 may include two switches that are positioned between nut 503 and a fret 505 that produce tones corresponding to tones generated by a bass guitar when the string is depressed at the first fret.

The switches of FIG. 4 and the strip of FIG. 6 may be coupled to the back of the neck of the guitar in many different ways. For example, in some embodiments the switches or strip are attached to the back of the neck using an adhesive, tape, Velcro, or any other attaching mechanism that allows a user to easily attach the switches or strip to the back of the neck of the guitar, preferably without unnecessarily damaging the guitar. In other embodiments, the switches or strip may be built into the guitar when it is manufactured.

Figure 7:
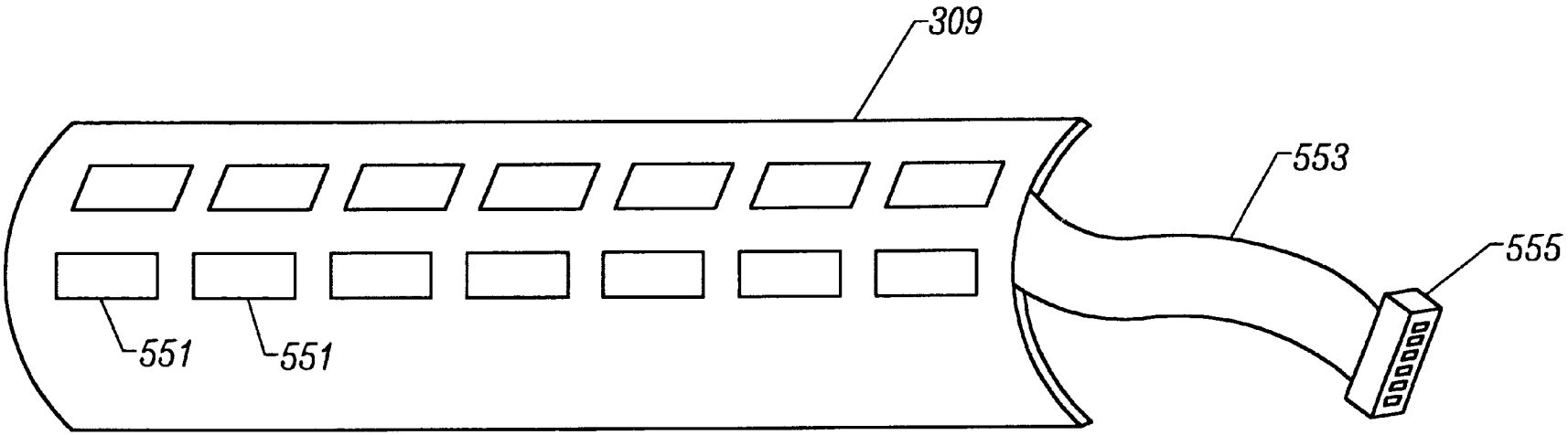
FIG. 7 shows a strip of switches that is adapted for mounting on the back of the neck of a musical instrument.

FIG. 7 shows a strip of switches that is adapted for mounting on the back of the neck of a musical instrument. As shown, strip 309 is shaped to conform to the curve of the back of the neck. Strip 309 includes switches 551 that are electrically coupled to a ribbon cable 553. A connector 555 may be utilized to connect the switches to an electronic device for producing sounds or controlling special effects.

It should be understood that the switches shown in the figures are representative of any number of conventional switching mechanisms. For example, the switch mechanisms may be membrane switches, rocker switches, variable resistance switches, touchpads, optical sensors, piezo transducers, and the like. The specific switch mechanism chosen may be based on a number of factors, including cost of production, responsiveness, durability, and user preference. Therefore, the invention is not limited to any specific switch mechanism.

Figure 8:
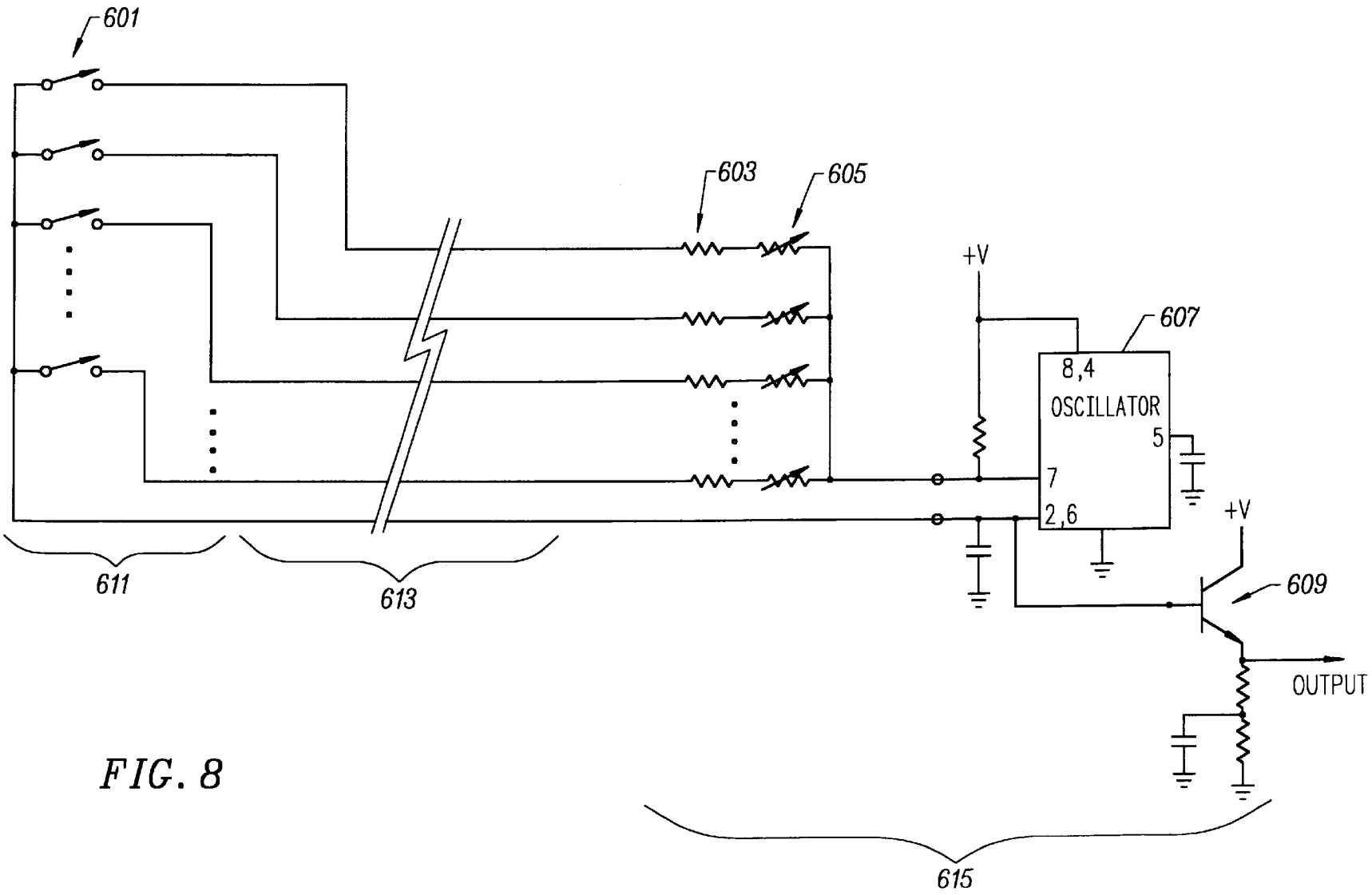
FIG. 8 shows an embodiment of an electronic circuit for producing analog electrical signals that may be passed to, for example, a bass amplifier that produces the desired tones.

Now that the position and operation of the switches has been described in detail, it may be desirable to show a schematic of the electrical components of an embodiment of the invention. FIG. 8 shows a schematic of an electronic circuit for producing analog electrical signals that may specify desired tones. Multiple switches 601 are positioned on the back of the neck of the musical instrument. Each switch 601 may correspond to a specific note and may be connected in series with resistors 603 and variable resistors 605. Resistors 603 are chosen so that the resistance will cause an oscillator to generate a signal at a pitch or frequency corresponding to the desired tone or note.

In one embodiment, variable resistors 605 are 2K ohm resistors and the resistance of resistors 603 in ohms are as follows:

| note | resistance |
|---|---|
| E | 2200 + 5500 |
| F | 1800 + 5500 |
| F# | 6800 |
| G | 1500 + 4700 |
| G# | 1500 + 4700 |
| A | 5600 |
| A# | 5100 |
| B | 4700 |
| C | 4700 |
| C# | 3900 |
| D | 3900 |
| D# | 3900 |
| E | 3300 |

Where there are two numbers, two resistors in series have been utilized to obtain the desired resistance. Resistors 601 provide a rough estimate of the desired resistance.

Variable resistors 605 allow for fine-tuning of the resistance. An oscillator 607 produces a signal corresponding to the detected resistance when one of switches 601 is activated. In a preferred embodiment, the electronic circuit includes an emitter follower circuit 609 that both isolates the input from the output and includes a voltage divider so that the voltages are within the desired range.

In order to put the schematic of FIG. 8 into perspective, a section 601 that includes switches 601 may be on the back of the neck of the musical instrument. A section 603 may be a ribbon cable and resistors 603, variable resistors 605, oscillator 607, and emitter follower circuit 609 shown as a section 615 may be incorporated in an electronic box (e.g., such as electronic box 211 in FIG. 2). In this manner, the invention may be plugged into a conventional bass amplifier to produce the desired notes. Although the electronic circuit shown in FIG. 8 produces excellent tonal quality, it has the disadvantage that there are many wires running down the back of the neck. For example, as shown in FIG. 8 there may be one wire for each switch on the back of the neck, in addition to a common wire.

An advantage of the embodiment of FIG. 8 is that it is simple. However, it does not include a MIDI interface, which may be desired.

Figure 9:
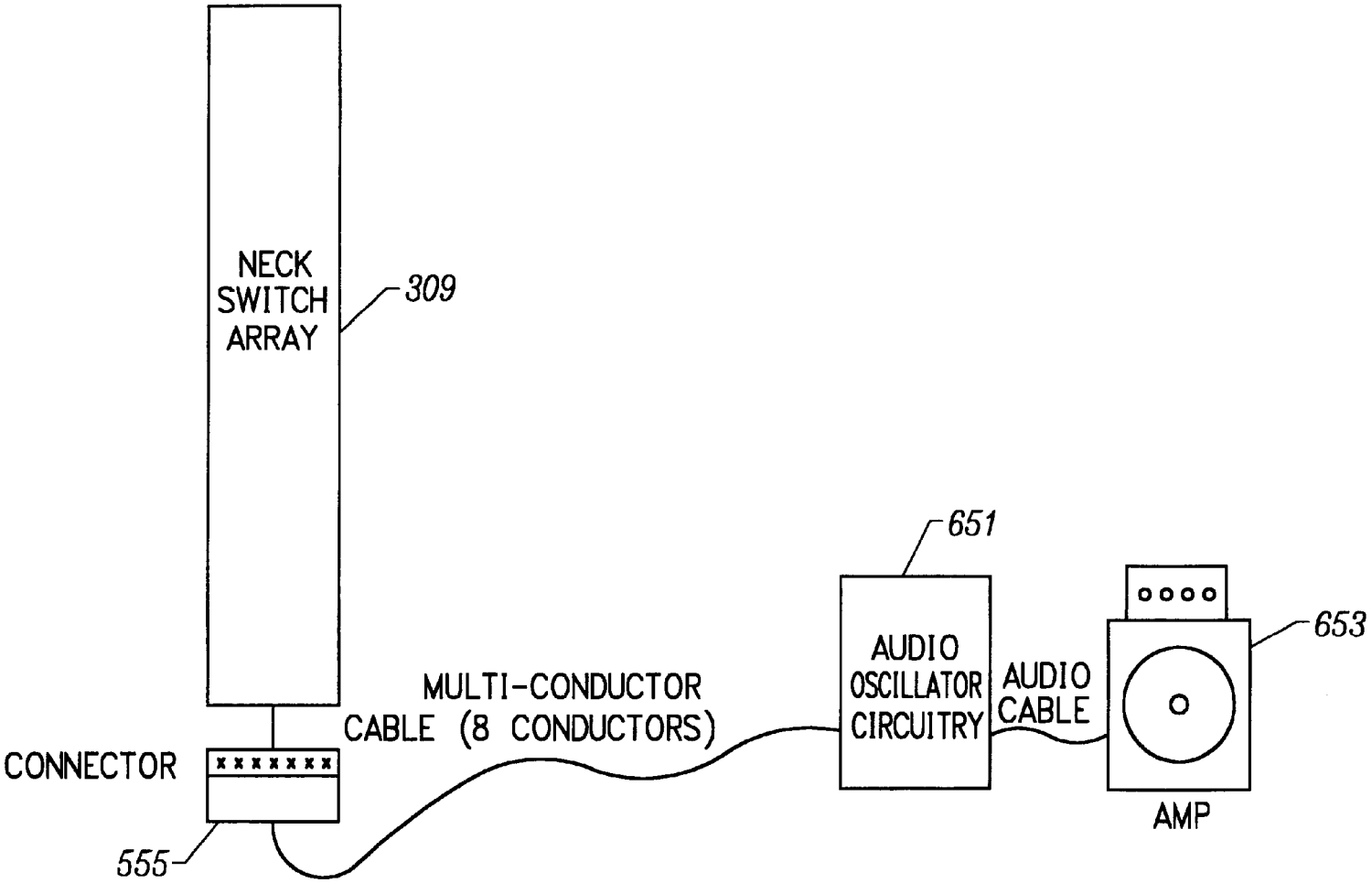
FIG. 9 shows an embodiment of the invention that utilizes MIDI digital signals and audio oscillator circuitry.

In another embodiment shown in FIG. 9, MIDI digital signals and audio oscillator circuitry are utilized. Strip of switches 309 is electrically connected to a connector 555. There are eight wires that are run along the back of the neck of the guitar, where six of the wires are data lines and 2 of the wires are voltage and ground lines. In this embodiment the musical instrument digital interface (MIDI) standard is utilized to represent the desired notes. MIDI is a standard protocol for the interchange of musical information between musical instruments, synthesizers and computers. The protocol defines digital codes for a musical invent including the start/stop of a note, its pitch, and volume. Audio oscillator circuitry 651 receives MIDI-like input from the strip of switches and produces analog signals that may be input into an amp 653 to produce the desired notes. The output from the strip of switches is not a MIDI signal but it may be a part of a MIDI signal that specifies the desired notes (or effects).

Figure 10:
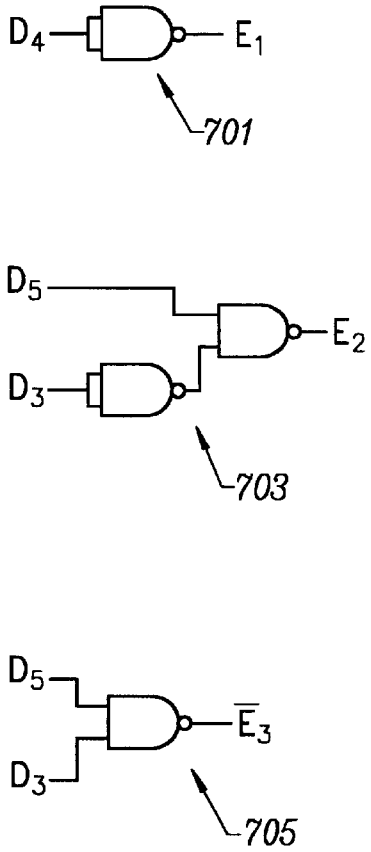
FIG. 10 shows how data lines may be mapped to MIDI digital signals.

FIG. 10 shows a chart of notes, their MIDI numbers, and the values of the six data lines that may be used to represent the notes. As will be described in more detail in reference to FIG. 12, the first four notes will be selected by a first multiplexer, the next eight notes will be selected by a second multiplexer, and the last six notes will be selected by a third multiplexer in one embodiment. The logic shown at the right of FIG. 10 illustrates how the data lines may be utilized to select the correct multiplexer. For example, the first multiplexer should be chosen if data line $D_4$ is true or a 1. A logic 701 represents the logic for a first multiplexer, a logic 703 represents the logic for a second multiplexer, and a logic 705 represents the logic for a third multiplexer. The number and delineation of each multiplexer may be varied in other embodiments.

Figure 11A:
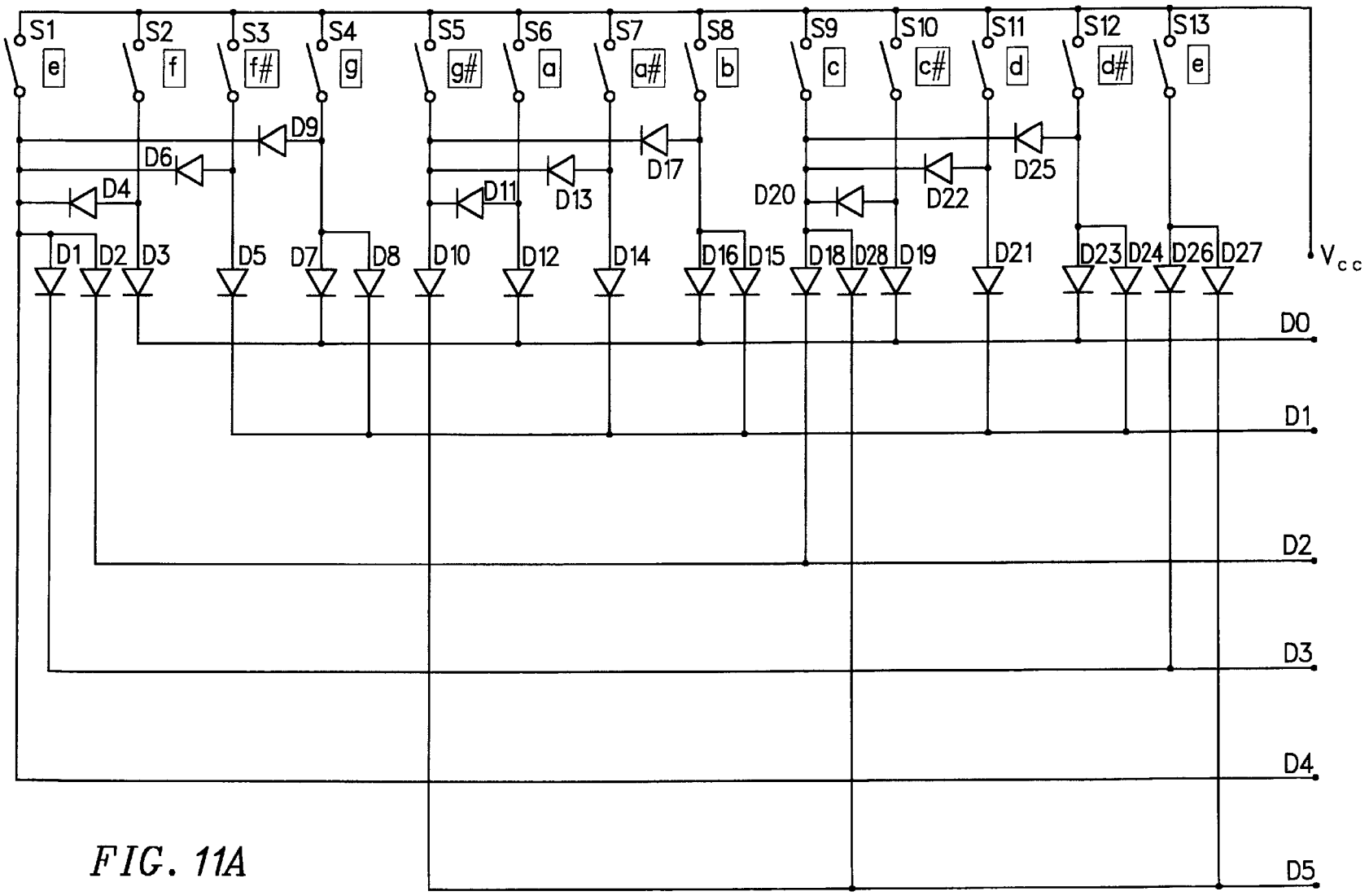
FIGS. 11A and 11B show data lines coupled to switches in order to specify MIDI digital signals.
Figure 11B:
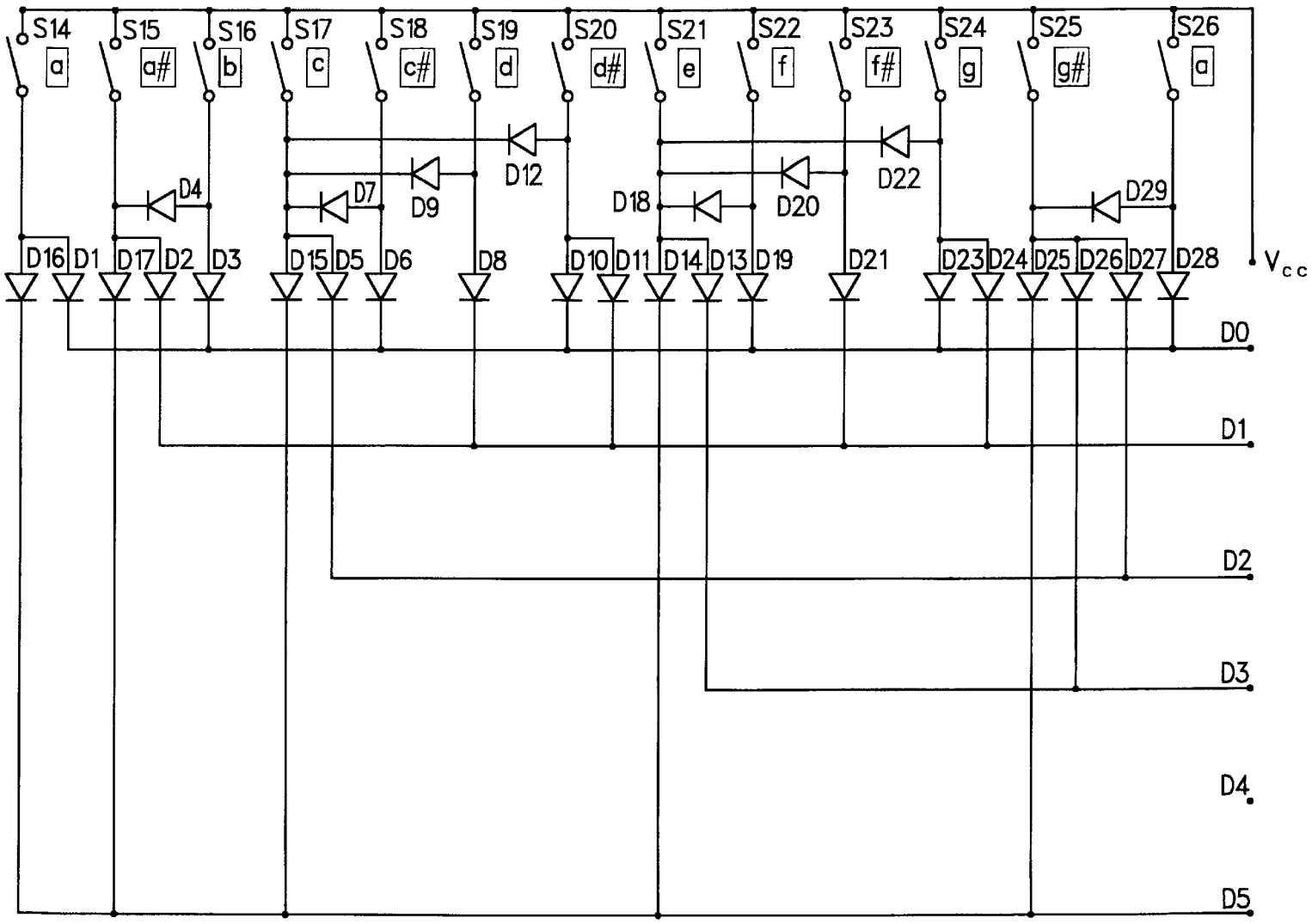

FIGS. 11A and 11B show how the switches may be electrically coupled to the data lines in order to produce signals corresponding to the MIDI signals shown in FIG. 10. More specifically, FIG. 11A represents the E string of a bass guitar and FIG. 11B represents the A string of a bass guitar. In FIG. 11A, the first note E corresponds to the lowest note on a bass guitar, which is produced when an open fourth string is struck. Referring back to FIG. 10, the MIDI signal for this note is 28, which corresponds to binary 011100. FIG. 11A shows that this binary number may be generated by coupling a switch $S_1$ to data lines $D_2$, $D_3$, and $D_4$. The diodes are preferably placed as shown to prevent the bi-directional flow of current.

Although 18 notes are shown in FIGS. 10, these notes represent notes from the two lower strings of a bass guitar. Each string of a bass guitar overlaps to some extent the notes on an adjacent string. Therefore, there may be multiple switches that produce the same note in the invention so there may be multiple switches in parallel for many notes.

Figure 12:
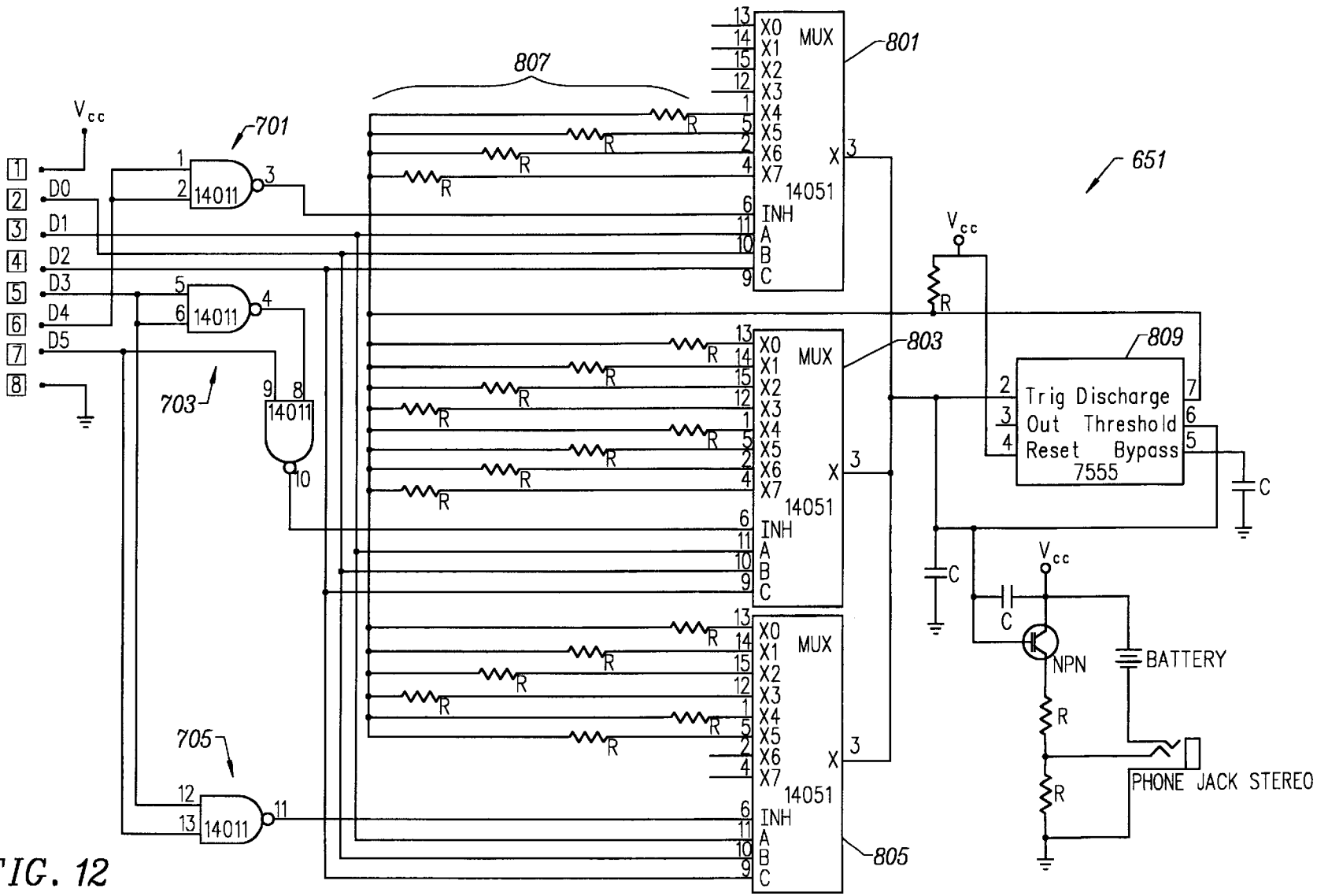
FIG. 12 shows an embodiment of audio oscillator circuitry 651 shown in FIG. 9.

FIG. 12 shows an embodiment of audio oscillator circuitry 651 shown in FIG. 9. The audio oscillator circuitry interprets the digital signals on the data lines and produces a signal that may be input to a stereo through a phone jack. Data lines $D_{0\text{-}5}$ are input into three multiplexers 801, 803, and 805 through the logic shown in FIG. 10, which is utilized to select which multiplexer should decode the data lines and select the desired note. Resistors 807 are chosen to specify the desired note and an oscillator 809 produces an oscillating signal. As discussed earlier, resistors 807 may be chosen to approximate the resistance for generating the desired tones. Variable resistors may also be utilized to finely tune the resistance, if desired.

Figure 13:
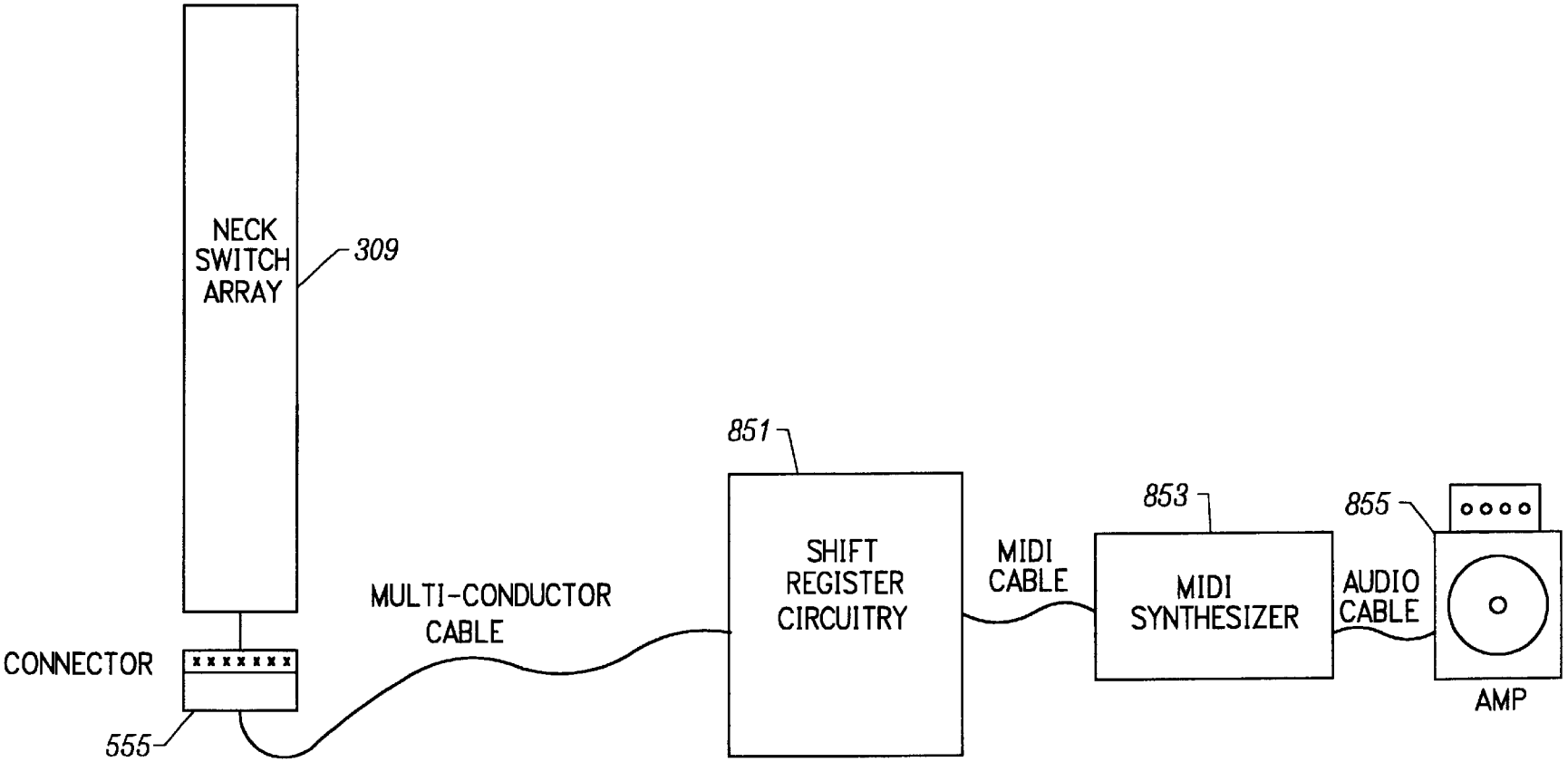
FIG. 13 shows an embodiment of the invention that utilizes MIDI digital signals and shift register circuitry.

In some embodiments, like the one shown in FIG. 3, the invention may be purely digital until analog signals corresponding to the desired sounds are generated by a synthesizer (e.g., a MIDI synthesizer). FIG. 13 shows a schematic of an embodiment of the invention that utilizes MIDI signals and shift register circuitry. Strip of switches 309 is electrically connected to a connector 555. Shift register circuitry 851 receives MIDI-like input from the strip of switches and produces MIDI signals that may be input into a MIDI synthesizer 853. The MIDI synthesizer generates analog signals that are input to an amp 855 to produce the desired notes.

Figure 14:
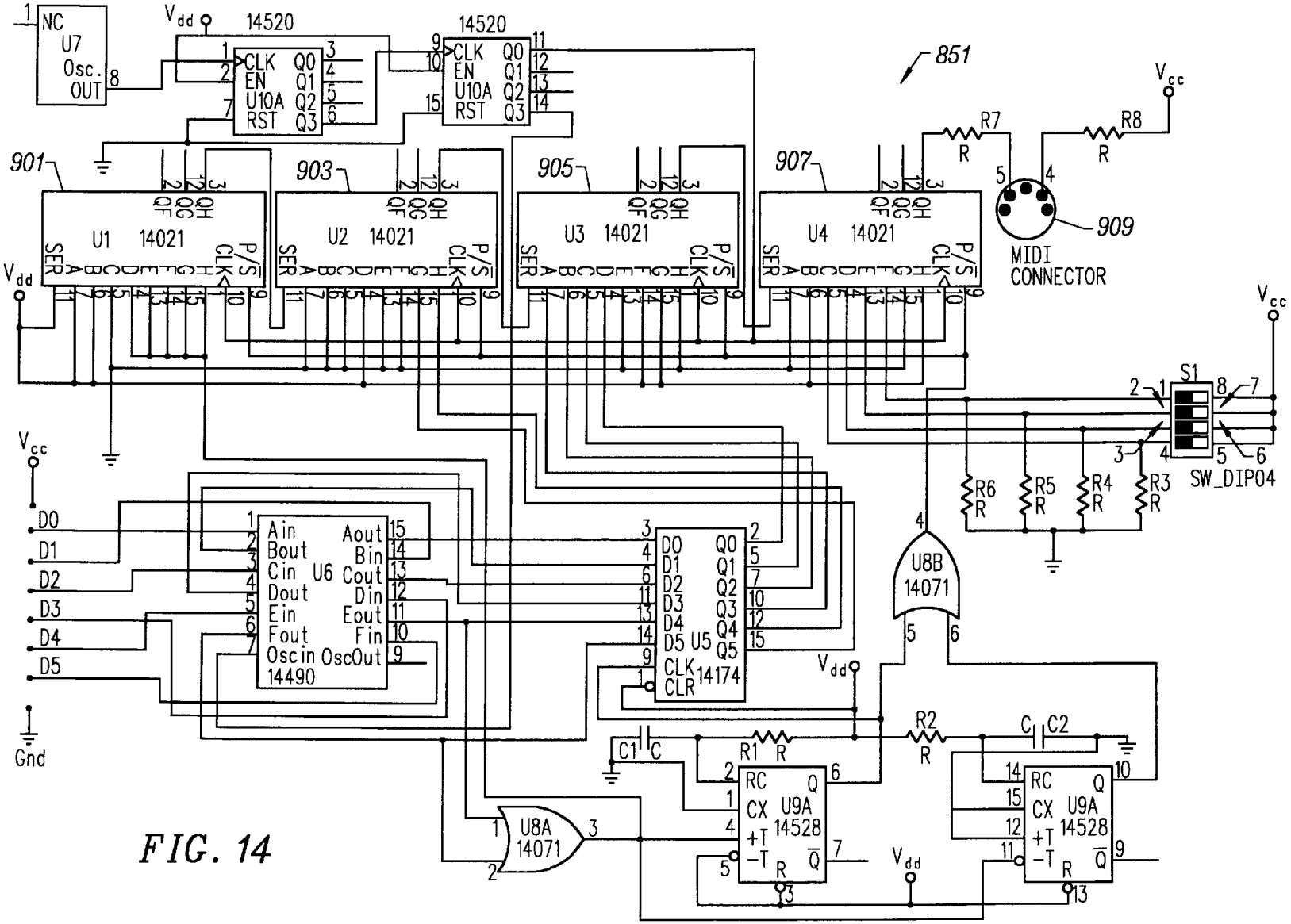
FIG. 14 shows an embodiment of shift register circuitry 851 shown in FIG. 13.

FIG. 14 shows an embodiment of shift register circuitry 851 of FIG. 13 that produces MIDI signals. MIDI signals generally include one 10-bit byte that specifies whether the note is on or off, one 10-bit byte that specifies the pitch of the note, and one 10-bit byte that specifies the volume of the note. Data lines $D_{0\text{-}5}$ that specify the pitch of the desired tone are input into shift registers that are clocked to generate the desired MIDI signals. More specifically, shift registers 901, 903, 905, and 907 receive the bits of the MIDI signals and then shift the bits out to a MIDI connector 909. The bits that specify whether the note is on or off and the volume may be set by shift register circuitry 851.

Once data is input into the shift registers, the shift registers shift data out to produce the 10-bit bytes that correspond to a MIDI signal. Referring again to FIG. 13, the MIDI signals may be input into MIDI synthesizer 853, which may be a computer with an appropriate sound card, to generate the sound.

An advantage of the embodiments of FIGS. 9–14 is that few conductors are required between the switches and the electronic circuitry. Additionally, the switch resistance does not affect tuning and electromagnetic interference is not generated. Furthermore, the MIDI note number is directly available and there is direct control for the oscillator.

Figure 15:
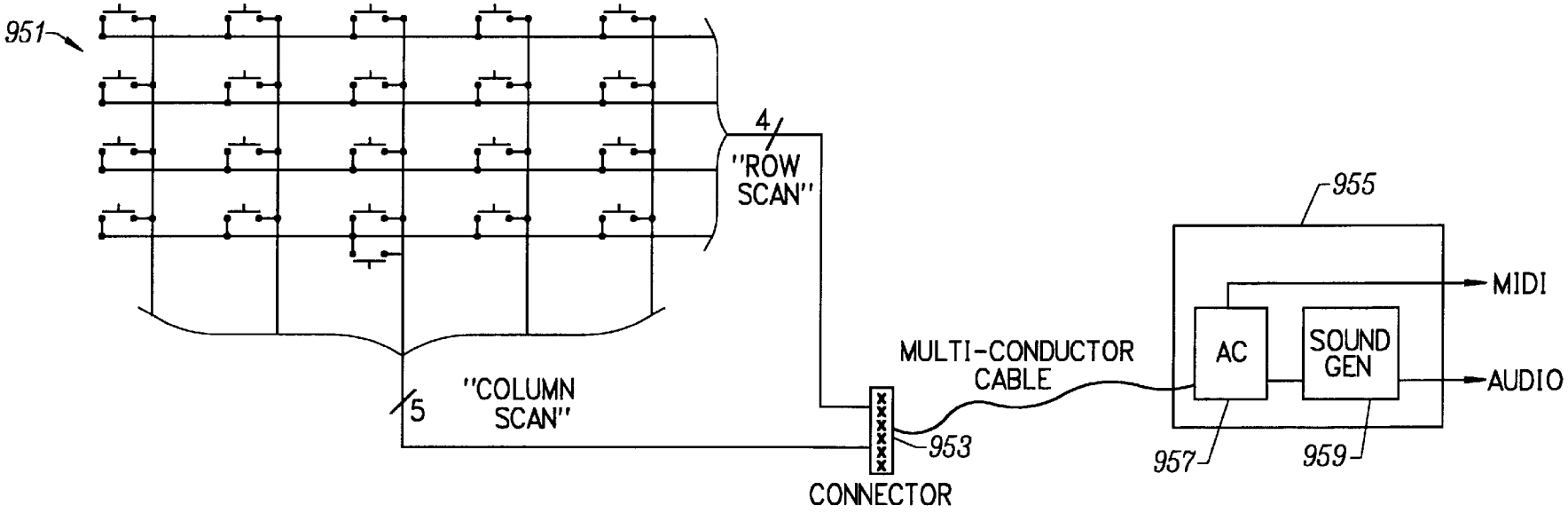
FIG. 15 shows an embodiment that utilizes a microprocessor to scan for activated switches.

FIG. 15 shows an embodiment that utilizes a microprocessor to scan for activated switches. A switch matrix 951 includes multiple rows and columns, four rows and five columns are shown but the dimensions may vary. The row and column lines are connected to a ribbon cable through a connector 953. A microprocessor-controlled circuit 955 is electrically connected to the switch matrix. The microprocessor-controlled circuit includes a microprocessor 957 and a sound generator chip 959.

During operation, microprocessor 957 may put logic "high" signals on all the row lines and monitor the column lines to see if any of these lines go "high." If a column line goes "high," a switch in that column has been activated or closed. In order to determine which switch in the column was activated, the microprocessor may send patterns of bits on the row lines and check the column line in order to determine which switch has activated. For example, if there are four rows, the microprocessor may send the bit patterns "1000," "0100," "0010," and "0001" and the bit pattern that causes the column line to go "high" indicates the activated switch (i.e., the switch with the "1" in the bit pattern).

Microprocessor 957 may be programmed, e.g., through a program stored in memory (not shown), to generate the appropriate MIDI digital signals. Additionally, the microprocessor may direct sound generator chip 959 to generate analog audio signals.

An advantage of the embodiment of FIG. 15 is that no diodes are required. Additionally, the electronic circuitry may be simple, small and inexpensive. Furthermore, the microprocessor may be utilized to control other devices or perform other functions.

While the above is a complete description of preferred embodiments of the invention, various alternatives, modifications, and equivalents may be used. It should be evident that the invention is equally applicable by making appropriate modifications to the embodiments described above. For example, there are many other signal standards that may be generated in addition to analog audio and MIDI signals. For example, embodiments may readily generate RS-232 signals, RS-485 signals, IEEE-488 signals, and so forth. Therefore, the above description should not be taken as limiting the scope of the invention that is defined by the metes and bounds of the appended claims along with their full scope of equivalents.

What is claimed is:

1. An apparatus for use with a musical instrument having a back of a neck, comprising:

a plurality of switches adapted for mounting on the back of the neck of the musical instrument so that the plurality of switches are positioned along the length of the back of the neck.

2. The apparatus of claim 1, wherein the plurality of switches includes switches that control electronic circuitry for producing sounds.

3. The apparatus of claim 2, wherein the sounds vary in pitch according to the position of each switch along the back of the neck.

4. The apparatus of claim 3, wherein the sounds correspond to tones produced by a bass guitar.

5. The apparatus of claim 2, wherein the sounds are chords.

6. The apparatus of claim 1, wherein at least one of the plurality of switches controls electronic circuitry that is not for producing sounds.

7. The apparatus of claim 6, wherein the at least one of the plurality of switches controls electronic circuitry for lighting control, stage effects control, sound control, synthesizer control, or recording control.

8. The apparatus of claim 1, wherein the plurality of switches are configured to be depressed by a user's thumb.

9. The apparatus of claim 1, further comprising a plurality of rows of switches across the length of the back of the neck.

10. The apparatus of claim 1, further comprising an electronic circuit coupled to the plurality of switches that detects when any of the plurality of switches is activated.

11. The apparatus of claim 10, wherein each of the plurality of switches produces a different electrical resistance when activated such that the electronic circuit generates a specified signal according to the electrical resistance.

12. The apparatus of claim 10, wherein each of the plurality of switches produces a different digital signal when activated such that the electronic circuit generates a specified musical instrument digital interface (MIDI) signal.

13. The apparatus of claim 10, wherein the electronic circuit scans the plurality of switches to ascertain an activated switch so that the electronic circuit generates a specified signal according to the activated switch.

14. A musical instrument, comprising:

a neck including a front and a back, wherein a fingerboard is on the front of the neck; and a plurality of switches positioned along the length of the back of the neck.

15. The musical instrument of claim 14, wherein the plurality of switches includes switches that control electronic circuitry for producing sounds.

16. The musical instrument of claim 15, wherein the sounds vary in pitch according to the position of each switch along the back of the neck.

17. The musical instrument of claim 16, wherein the sounds correspond to tones produced by a bass guitar.

18. The musical instrument of claim 15, wherein the sounds are chords.

19. The musical instrument of claim 14, wherein at least one of the plurality of switches controls electronic circuitry that is not for producing sounds.

20. The musical instrument of claim 19, wherein the at least one of the plurality of switches controls electronic circuitry for lighting control, stage effects control, sound control, synthesizer control, or recording control.

21. The musical instrument of claim 14, wherein the plurality of switches are configured to be depressed by a user's thumb.

22. A method of augmenting a musical instrument, comprising:

providing a musical instrument with a neck including a front and a back, wherein a fingerboard is on the front of the neck; and coupling a plurality of switches for producing sounds along the length of the back of the neck.

23. The method of claim 22, wherein coupling includes utilizing an adhesive to attach the plurality of switches.

24. The method of claim 22, further comprising electrically coupling the plurality of switches to an electronic circuit that generates electrical signals corresponding to desired sounds.

25. A method of playing a musical instrument with a neck including a front and a back, comprising:

coupling fingers of a hand to a fingerboard on the front of the neck in order to produce tones of varying pitch; and coupling the thumb of the hand to at least one of a plurality of switches positioned along the length of the back of the neck.

26. The method of claim 25, wherein the thumb plays a different part of a musical piece than the fingers.

27. The method of claim 25, wherein the plurality of switches includes switches that control electronic circuitry for producing sounds.

28. The method of claim 27, wherein the sounds vary in pitch according to the position of each switch along the back of the neck.

29. The method of claim 28, wherein the sounds correspond to tones produced by a bass guitar.

30. The method of claim 27, wherein the sounds are chords.

31. The method of claim 25, wherein at least one of the plurality of switches controls electronic circuitry that is not for producing sounds.

32. The method of claim 31, wherein the at least one of the plurality of switches controls electronic circuitry for lighting control, stage effects control, sound control, synthesizer control, or recording control.

* * * * *